US007530225B2

(12) United States Patent
Ikeda

(10) Patent No.: US 7,530,225 B2
(45) Date of Patent: May 12, 2009

(54) APPARATUS FOR INCREASING OPERATION SPEED OF BOOM ON EXCAVATORS

(75) Inventor: Toshimichi Ikeda, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 223 days.

(21) Appl. No.: 11/637,569

(22) Filed: Dec. 12, 2006

(65) Prior Publication Data

US 2007/0271913 A1 Nov. 29, 2007

(30) Foreign Application Priority Data

May 23, 2006 (KR) ..... 10-2006-0046162
Nov. 10, 1926 (KR) ..... 10-2006-0110880

(51) Int. Cl.
*E02F 3/43* (2006.01)
*F15B 11/02* (2006.01)

(52) U.S. Cl. ..... 60/421; 60/484

(58) Field of Classification Search ..... 60/421, 60/484, 486
See application file for complete search history.

(56) References Cited

U.S. PATENT DOCUMENTS 4,896,442 A 1/1990 Stiff et al.

FOREIGN PATENT DOCUMENTS

DE 15 56 720 2/1970
EP 1 600 643 11/2005
JP 62 055336 3/1987
JP 62 055337 3/1987
JP 62055337 A * 3/1987
JP 62 284835 12/1987
JP 62 284836 12/1987
JP 63 247430 10/1988

OTHER PUBLICATIONS

Patent Abstracts of Japan of JP 62055337 dated Mar. 11, 1987.
Patent Abstracts of Japan of JP 62055336 dated Mar. 11, 1987
Patent Abstracts of Japan of JP 62284836 dated Dec. 10, 1987.
Patent Abstracts of Japan of JP 62284835 dated Dec. 10, 1987.
Patent Abstracts of Japan of JP 63247430 dated Oct. 14, 1988.

* cited by examiner

*Primary Examiner*—Thomas E Lazo
(74) *Attorney, Agent, or Firm*—Ladas & Parry LLP

(57) ABSTRACT

An apparatus for increasing an operation speed of a boom on excavators is disclosed, which enables an unskilled operator to conveniently manipulate a working device by decreasing a rotation speed and increasing a lifting speed relatively when the excavator performs combined operation of boom lift and swing drive to improve its working efficiency. The apparatus includes first and second hydraulic pumps, a first actuator, a pair of second actuators, first to third control valves, a block valve installed in a flow path between the selected second actuator and the second control valve, supplying the hydraulic fluid from a second hydraulic pump to the selected actuator only when the second actuators are driven to be switched according to a control signal of boom lift at combined operation in which the first and second actuators are simultaneously driven, to replenish the first actuator with the hydraulic fluid to be supplied to the second actuator.

7 Claims, 9 Drawing Sheets

APPARATUS FOR INCREASING OPERATION SPEED OF BOOM ON EXCAVATORS

CROSS-REFERENCE TO RELATED APPLICATION

This application is based on and claims priority from Korean Patent Application Nos. 10-2006-46162 and 10-2006-110880, filed on May 23, 2006 and Nov. 10, 2006, respectively, in the Korean Intellectual Property Office, the disclosure of which is incorporated herein in its entirety by reference.

BACKGROUND OF THE INVENTION

1. Field of the Invention

The present invention relates to an apparatus for increasing an operation speed of a boom on excavators, which enables an operator to increase a lifting speed of the boom and simultaneously decrease a rotation speed of an upper swing structure when the boom is operated in a vertical plane (lifting) simultaneously with rotation of the upper swing structure in a horizontal plane (swing).

More particularly, the present invention relates to an apparatus for increasing an operation speed of a boom on excavators, which enables an unskilled operator to conveniently manipulate a working device by decreasing a rotation speed of the swing and increasing a lifting speed of the boom relatively when the excavator performs combined operation containing the lifting of the boom and the swing of the upper swing structure to improve its working efficiency.

2. Description of the Prior Art

A conventional excavator includes, as shown in FIG. 1, a lower driving structure 1; an upper swing structure 5 mounted on the lower driving structure 1 and rotated in a horizontal plane by a driving means having a swing motor 2, a pinion gear 3 fixed on the swing motor 2, and an internal gear 4 meshed with the pinion gear 3; a operation cab 6 and an engine 7 mounted on the upper swing structure 5; a working device 14 mounted on the upper swing structure 5 and having a boom 9 driven by a boom cylinder 8, an arm 11 driven by an arm cylinder 10, and a bucket 13 driven by a bucket cylinder 12; and a counterweight 15 mounted on the rear side of the upper swing structure 5 and having a weight (not shown) so as to maintain a balance of the equipment at working.

Referring to FIG. 2, a power generating unit driving the excavator includes an engine 16, a hydraulic pump 17 driven by the engine 16 to supply a hydraulic fluid to an actuator(s) A; 8, 10, and 12 of the working device 14, and a control valve 18 installed in a flow path between the hydraulic pump 17 and the actuator 17 to control the hydraulic fluid supplied to the actuator A.

Reference numeral "19" denotes a radiator, "20" denotes an oil cooler cooling the hydraulic fluid to be returned, and "21" denotes a hydraulic tank.

A conventional hydraulic circuit for driving the boom and the swing motor includes, as shown in FIG. 3, first and second hydraulic pumps 16*a* and 16*b* connected to the engine 16; a first actuator 8 (i.e., a boom cylinder) connected to the first hydraulic pump 16*a*; and a second actuator 2 (i.e., a swing motor) connected to the second hydraulic pump 16*b*.

The conventional hydraulic circuit for driving the boom and the swing motor also includes a first control valve 22 installed in flow paths 25 and 26 between the first hydraulic pump 16*a* and the first actuator 8 and switched to control startup, stop, and turnabout of the first actuator 8; a second control valve 23 installed in flow paths 29 and 30 between the second hydraulic pump 16*b* and the second actuator 2 and switched to control startup, stop, and turnabout of the second actuator 2; and a third control valve 24 installed in flow paths 27 and 28 between the second hydraulic pump 16*b* and the first actuator 8 (in this case, the flow paths 27 and 28 are communicated with the flow paths 25 and 26 connected to the first control valve) and switched to join a part of the hydraulic fluid of the second hydraulic pump 16*b* into the first actuator 8.

The operation of lifting the boom will now be described with reference to FIG. 3.

If a control signal is inputted to the right port of the first control valve 22 by an operator, an inner spool of the first control valve 22 is shifted in a left direction on the figure (i.e., it is shifted to the position a). The hydraulic fluid discharged from the first hydraulic pump 16*a* is supplied to a large chamber of the first actuator 8 via the first control valve 22 and the flow path 25 to lift the boom 9. At that time, the hydraulic fluid discharged from the first actuator 8 is returned to the hydraulic tank via the flow path 26 and the first control valve 22.

By contrast, if the first control valve 22 is shifted in a right direction on the figure (i.e., to the position b), the hydraulic fluid discharged from the first hydraulic pump 16*a* is supplied to a small chamber of the first actuator 8 via the first control valve 22 and the flow path 26 to lower the boom 9. In this case, the hydraulic fluid discharged from the first actuator 8 is returned to the hydraulic tank via the flow path 25 and the first control valve 22.

The operation of swinging the upper swing structure will now be described with reference to FIG. 3.

If a control signal is inputted to the left port of the second control valve 23 by the operator, an inner spool of the second control valve 23 is shifted in a right direction on the figure (i.e., it is shifted to the position e). The hydraulic fluid discharged from the second hydraulic pump 16*b* is supplied to the second actuator 2 via the second control valve 23 and the flow path 30 to rotate the swing motor 2.

Thus, the pinion gear 3 fixed to the swing motor 2 is meshed with the internal gear 4 fixed to the upper swing structure 5 to rotate the upper swing structure 5. At that time, the hydraulic fluid discharged from the second actuator 2 is returned to the hydraulic tank via the flow path 29 and the second control valve 23.

The principle of increasing the lifting speed of the boom will now be described with reference to FIG. 3.

When the operator operates the control lever to lift the boom, a control signal is inputted to the left port of the third control valve 24 by the operator, and thus an inner spool of the third control valve 24 is shifted to the left direction on the figure (i.e., it is shifted to the position c). The hydraulic fluid discharged from the second hydraulic pump 16*b* is supplied to the first actuator 8 via the third control valve 24 and the flow paths 27 and 25. That is, a part or all of the hydraulic fluid discharged from the second hydraulic pump 16*b* is joined into the first actuator 8 to increase the lifting speed of the boom 9.

The hydraulic fluid discharged from the first actuator 8 is returned to the hydraulic tank via the flow path 26 and the first control valve 22, and simultaneously, the hydraulic fluid is returned to the hydraulic tank via the flow path 28 and the third control valve 24. At this time, the first control valve 22 is opened, and then the third control valve 24 is opened.

The operation of lifting the boom simultaneously with the rotation of the upper swing structure will be now described with reference to FIG. 3.

At the excavation and loading work on to a dump truck, the bucket 13 is pressed into the soil ground by the combined operation work of boom down, arm in, and bucket in motion, and then lifted up by boom up operation. After that, the upper swing structure 5 is swung to load the soil onto the dump truck. The above process is repeatedly carried. In this case, the operator conducts the operation of lifting the boom 9 and swinging the upper swing structure 5 at the same time, in order to cut down a cycle time.

In this case, since a load is given to the bucket 13 with the soil loaded therein, the lifting speed of the boom 9 becomes slower, while the rotation speed of the upper swing structure 5 becomes relatively faster due to the increased pressure. Thus, while the operator waits during the lifting time of the boom 9, the operator has to decrease the rotation speed of the upper swing structure 5 by adjusting lever stroke for swing speed control. Therefore, in the case of manipulating lifting the boom simultaneously with the rotation of the upper swing structure to perform the combined operation, experience and skill are required to the operator.

SUMMARY OF THE INVENTION

Accordingly, the present invention has been made to solve the above-mentioned problems occurring in the prior art while advantages achieved by the prior art are maintained intact.

One object of the present invention is to provide an apparatus for increasing an operation speed of a boom on excavators, which enables an operator to easily manipulate an working device by automatically decreasing a rotation speed of the upper swing structure and increasing a lifting speed of the boom relatively when the excavator performs combined operation of the lifting of the boom and the swing of the upper swing structure.

In order to accomplish this object, there is provided an apparatus for increasing an operation speed of a boom on excavators, according to the present invention, which includes first and second hydraulic pumps; a first actuator connected to the first hydraulic pump; a pair of second actuators connected to the second hydraulic pump and connected in series to each other; a first control valve installed in a flow path between the first hydraulic pump and the first actuator, which functions to control startup, stop, and turnabout of the first actuator; a second control valve installed in a flow path between the second hydraulic pump and the second actuators, which functions to control startup, stop, and turnabout of the second actuators; a third control valve installed in a flow path between the second hydraulic pump and the first actuator, which functions to join a part of a hydraulic fluid of the second hydraulic pump into the first actuator; and a block valve installed in the flow path between the second actuators and the second control valve, supplying the hydraulic fluid from the second hydraulic pump to one of the second actuators to be selected only when the second actuators are driven to be switched according to a control signal of boom lift at combined operation in which the first and second actuators are simultaneously driven, to replenish the first actuator with the hydraulic fluid to be supplied to the second actuator.

In one embodiment of the present invention, the control signal to switch the block valve may be the following means:

a) A pilot signal pressure switching the third control valve to drive the first actuator;

b) An electric signal switching the third control valve to drive the first actuator;

c) Operator's physical manipulation of the block valve such as a hand or a foot;

d) A pilot signal pressure switching the first control valve to drive the first actuator; and e) An electric signal switching the first control valve to drive the first actuator.

The first actuator may be a boom cylinder, and the second actuator may be a swing motor.

In another aspect of the present invention, there is provided an apparatus for increasing an operation speed of a boom on excavators, which includes first and second hydraulic pumps; a first actuator connected to the first hydraulic pump; a second variable displacement actuator connected to the second hydraulic pump; a first control valve installed in a flow path between the first hydraulic pump and the first actuator, which functions to control startup, stop, and turnabout of the first actuator; a second control valve installed in a flow path between the second hydraulic pump and the second actuators, which functions to control startup, stop, and turnabout of the second actuator; a third control valve installed in a flow path between the second hydraulic pump and the first actuator, which functions to join a part of a hydraulic fluid of the second hydraulic pump into the first actuator; and a variable displacement device installed in the second actuator, which is driven according to a control signal of boom lift at combined operation in which the first and second actuators are simultaneously driven, to replenish the first actuator with a part of the hydraulic fluid from the second hydraulic pump to the second actuator.

In another embodiment of the present invention, the control signal to drive the variable displacement device may be the following means:

a) A pilot signal pressure switching the third control valve to drive the first actuator;

b) An electric signal switching the third control valve to drive the first actuator;

c) A pilot signal pressure switching the first control valve to drive the first actuator; and d) An electric signal switching the first control valve to drive the first actuator.

The first actuator may be a boom cylinder, and the second actuator may be a variable displacement swing motor.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 5:
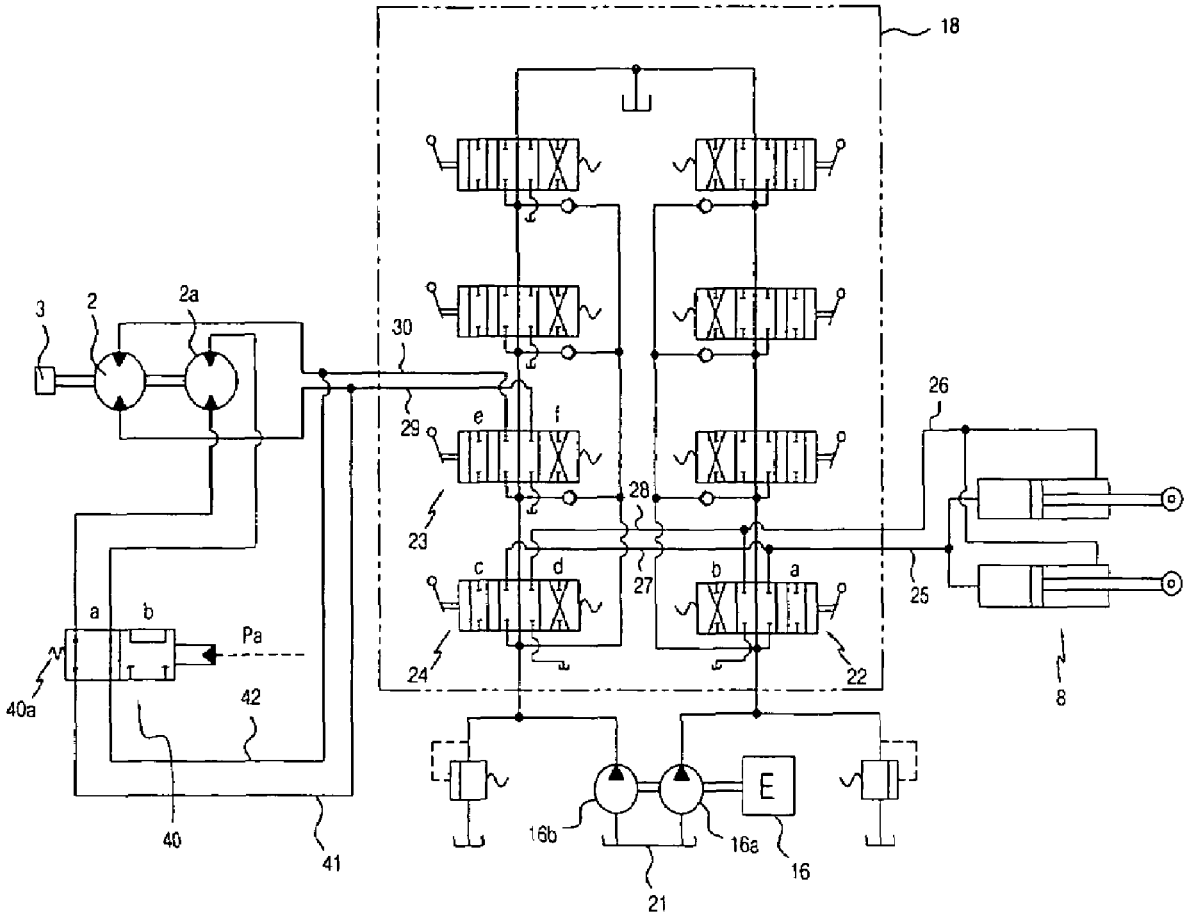
FIG. 5 is a hydraulic circuit diagram of an apparatus for increasing an operation speed of a boom on excavators according to an embodiment of the present invention.

An apparatus for increasing an operation speed of a boom on excavators according to an embodiment of the present invention includes, as shown in FIG. 5, first and second hydraulic pumps 16*a* and 16*b* connected to an engine 16; a first actuator 8 (i.e., a boom cylinder) connected to the first hydraulic pump 16*a*; a pair of second actuators 2*a* and 2*b* (i.e., a swing motor) connected to the second hydraulic pump 16*b* and connected in series to each other; a first control valve 22 installed in flow paths 25 and 26 between the first hydraulic pump 16*a* and the first actuator 8 and switched to control startup, stop, and turnabout of the first actuator 8 when a control signal is input from an exterior; a second control valve 23 installed in flow paths 29 and 30 between the second hydraulic pump 16*b* and the second actuators 2 and 2*a* and switched to control startup, stop, and turnabout of the second actuator 2 when a control signal is input from an exterior; a third control valve 24 installed in flow paths 27 and 28 between the second hydraulic pump 16*b* and the first actuator 8 (in this case, the flow paths 27 and 28 are communicated with the flow paths 25 and 26 connected to the first control valve 22) and switched to join a part of the hydraulic fluid of the second hydraulic pump 16*b* into the first actuator 8 when a control signal is input from an exterior; and a block valve 40 installed in flow paths 41 and 42 between the second actuator 2*a* and the second control valve 23 (in this case, the flow paths 41 and 42 are communicated with the flow paths 29 and 30 connected to the second actuator 2) to supply the hydraulic fluid from the second hydraulic pump 16*b* to the actuator 2*a* to be selected from the second actuators 2*a*, 2 only when the second actuators 2 and 2*a* are driven to be switched according to a control signal Pa inputted from an outside at combined operation in which the first and second actuators 8 and 2 are simultaneously driven, to replenish the first actuator 8 with the hydraulic fluid to be supplied to the second actuator 2*a*.

A pilot signal pressure or an electric signal switching the third control valve 24 to drive the first actuator 8 may be used as the control signal Pa switching the block valve 40.

The block valve 40 may be switched by manipulation of an operator's hand or foot.

A pilot signal pressure or an electric signal switching the first control valve 22 to drive the first actuator 8 may be used as the control signal Pa switching the block valve 40.

Figure 1:
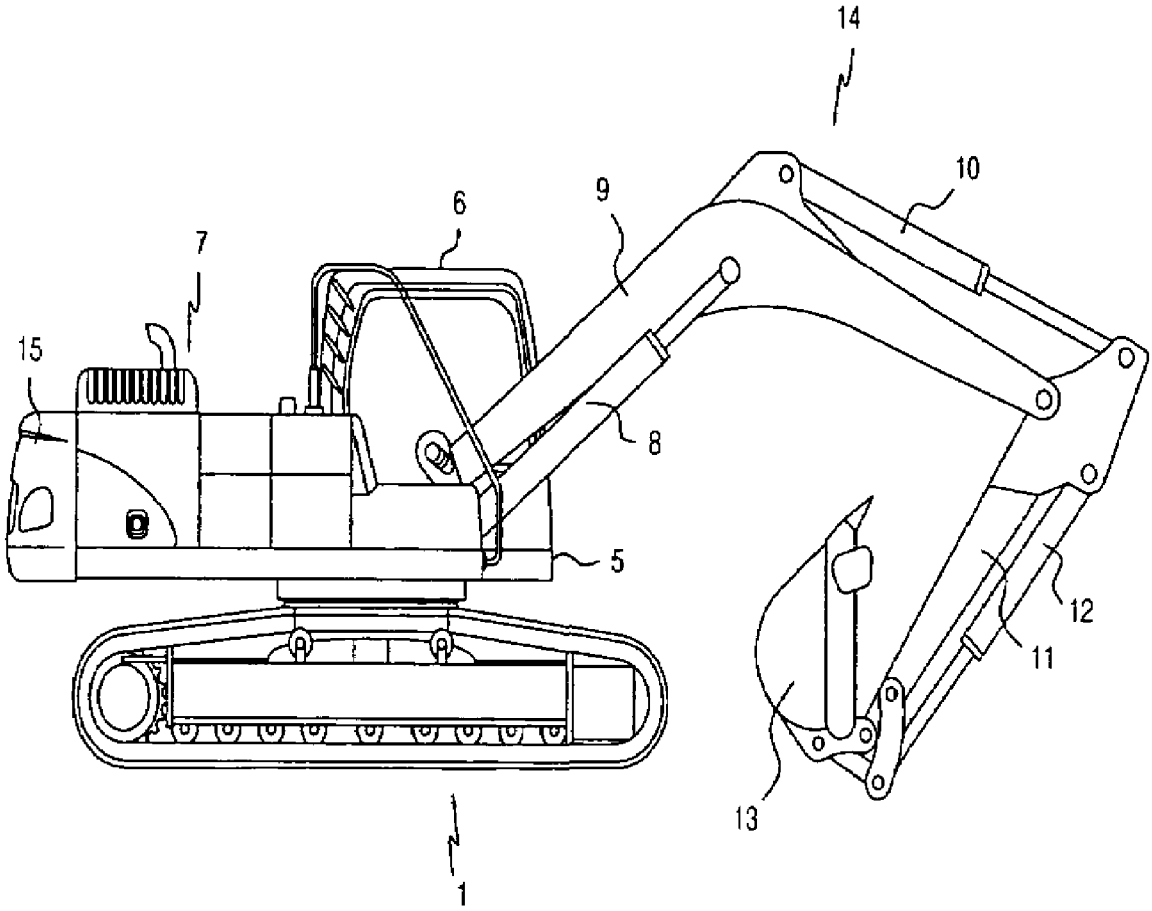
Fig. 1 Prior Art
FIG. 1 is a side view of a conventional excavator.
Figure 2:
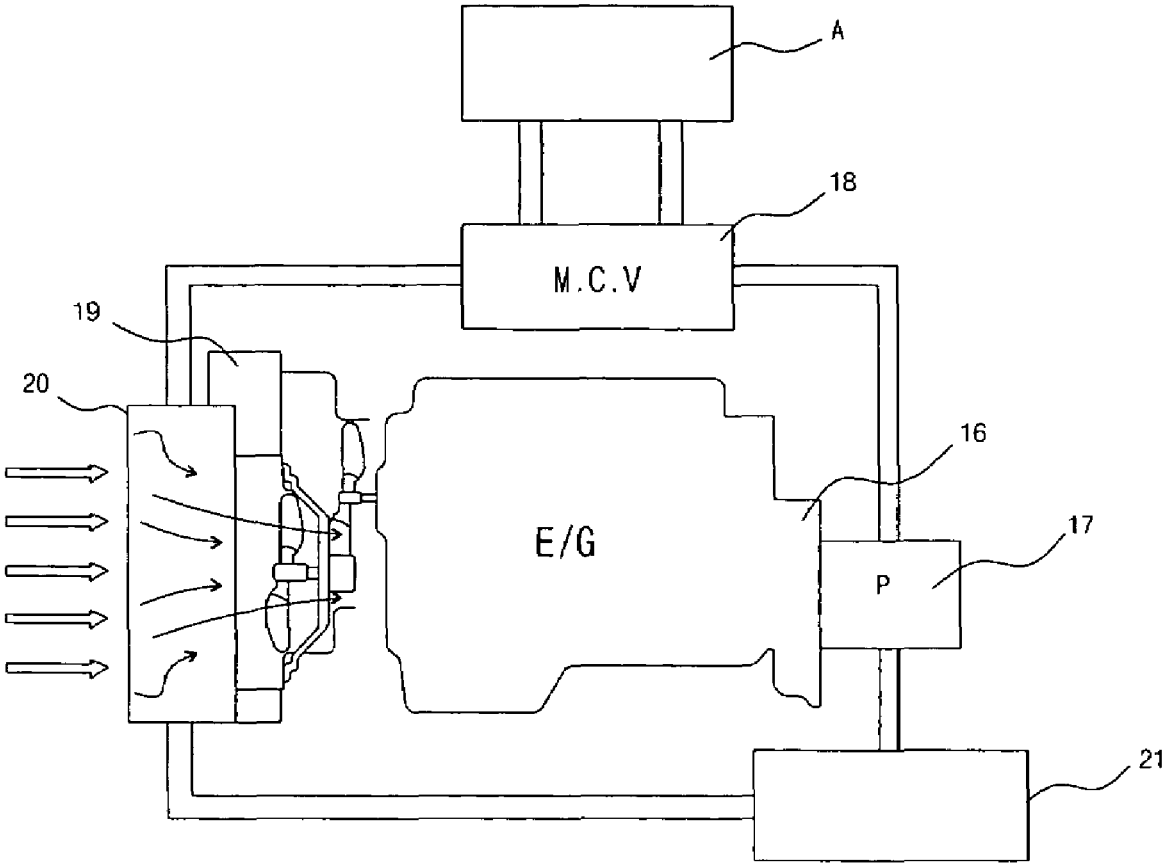
Fig. 2 Prior Art
FIG. 2 is a perspective view of a power generating unit driving an excavator.
Figure 3:
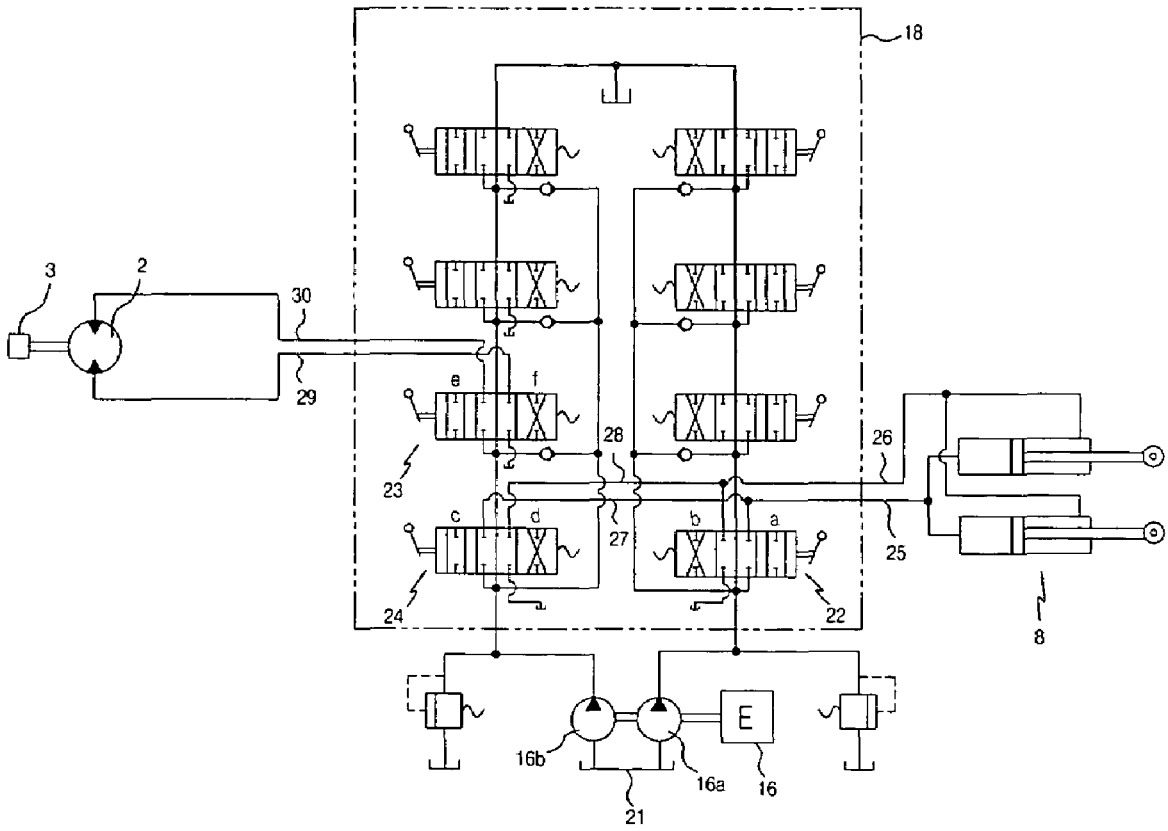
Fig. 3 Prior Art
FIG. 3 is a diagram of a conventional hydraulic circuit operating a boom and a swing motor on an excavator.
Figure 4:
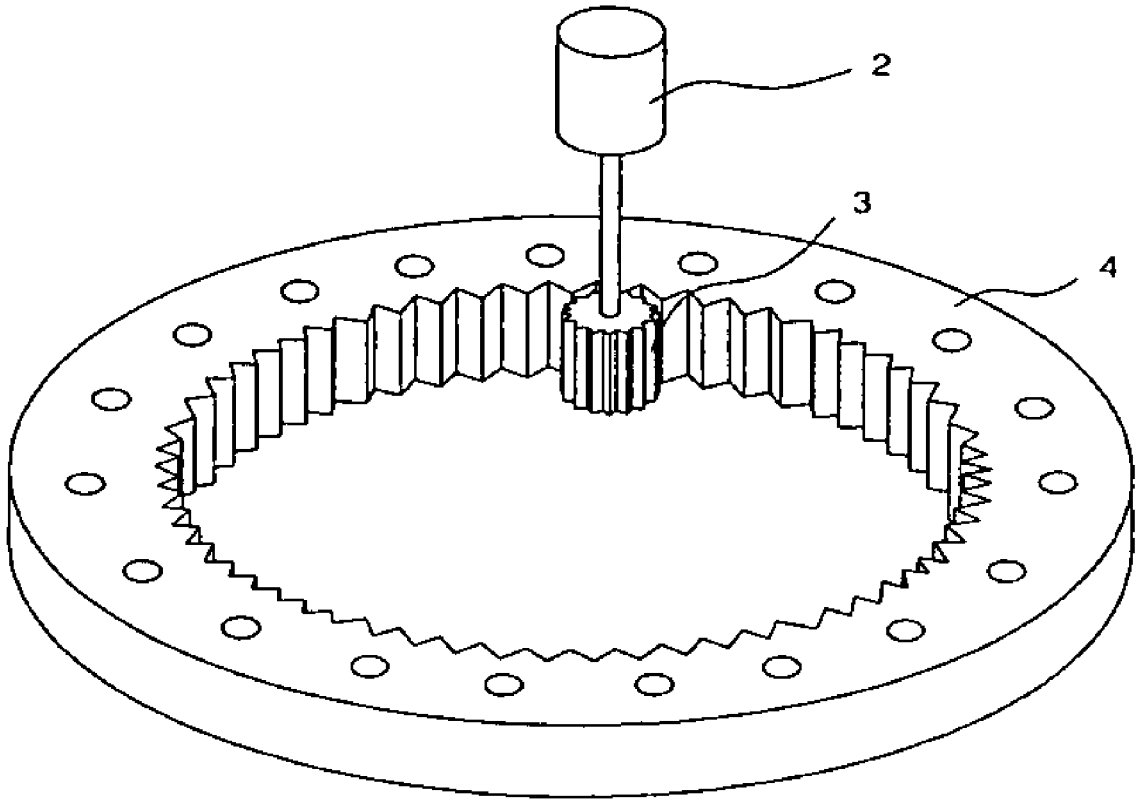
Fig. 4 Prior Art
FIG. 4 is a perspective view explaining the mechanism connecting an upper swing structure and a swing motor in the prior art.

The elements substantially equal to those in FIG. 3 are denoted by the same reference numerals, and the detailed description of their structure and operation will be omitted.

The apparatus for increasing the operation speed of a boom on excavators according to an embodiment of the present invention will now be described with reference to the accompanying drawings.

As shown in FIG. 5, if an operator switches the first control valve 22, the first actuator 8 (i.e., a boom cylinder) is driven by the hydraulic fluid discharged from the first hydraulic pump 16*a*. A part of the hydraulic fluid discharged from the second hydraulic pump 16*b* is joined into the first actuator 8 by switching the third control valve 24 to increase the operation speed of the first actuator 8. This operation is substantially equal to that in FIG. 3, and thus will not be described herein.

Figure 6:
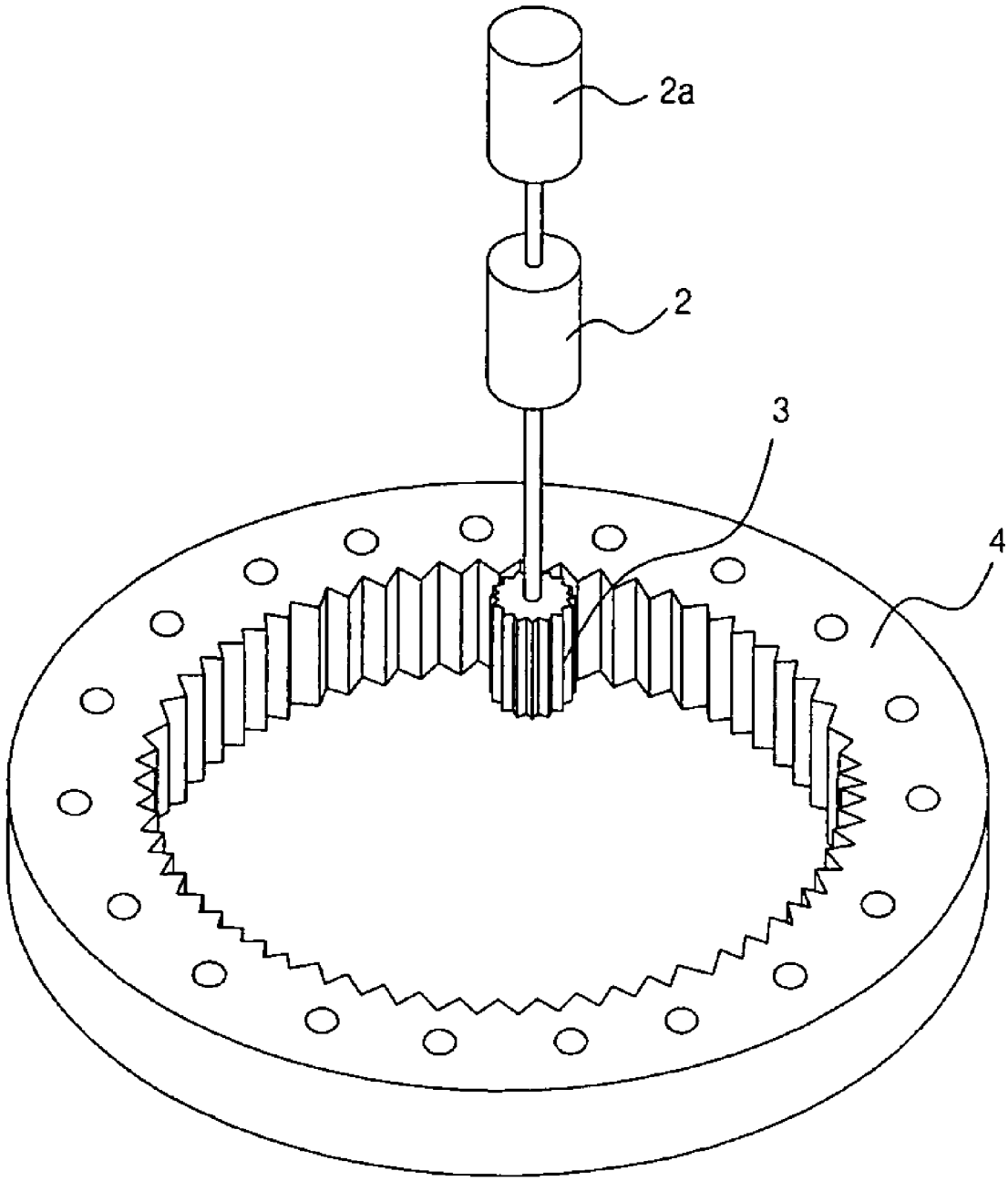
FIG. 6 is a perspective view explaining the mechanism connecting an upper swing structure and a swing motor according to an embodiment of the present invention.

The operation of driving the upper swing structure according to an embodiment of the present invention will now be described with reference to FIGS. 5 and 6.

If a control signal is inputted to the left port of the second control valve 23 by the operator, an inner spool of the second control valve 23 is shifted in a right direction on the figure (i.e., it is shifted to the position e). The hydraulic fluid discharged from the second hydraulic pump 16*b* is supplied to the second actuator 2 via the second control valve 23 and the flow path 30. Simultaneously, a part of the hydraulic fluid discharged from the second hydraulic pump 16*b* is supplied to the second actuator 2*a* via the second control valve 23, the flow paths 29 and 42, and the block valve 40 (i.e., it is shifted to the position a).

Thus, a pinion gear 3 is meshed with an internal gear 4 by the driving force outputted from the pair of swing motors 2 and 2*a* to rotate the upper swing structure 5.

The operation of lifting the boom simultaneously with the rotation of the upper swing structure according to an embodiment of the present invention will be now described with reference to FIG. 5.

If a control signal Pa (e.g., pilot signal pressure or electric signal) is inputted to the right port of the block valve 40 by the operator, an inner spool of the block valve 40 is shifted in a left direction on the figure (i.e., it is shifted to the position b). At that time, a valve spring 40*a* is compressed.

Since the input-side flow paths 41 and 42 of the block valve 40 are closed, the hydraulic fluid discharged from the second hydraulic pump 16*b* is supplied to only the second actuator 2 via the flow paths 29 and 30. That is, the upper swing structure 5 is rotated only by the driving force transferred from the second actuator 2 of the pair of second actuators 2 and 2*a* to be connected in series or in tandem.

In this case, the actuator 2*a* is idled by the communicated circuit in the block valve. Since the torque to drive the upper swing structure 5 is decreased (reduced by half in the case that the second actuators 2 and 2*a* have the same capacity), an acceleration of the swing structure is reduced, and thus the increase of speed is restrained. Consequently, the rotating speed of the second actuator 2 is decreased, and thus the required flow rate is decreased. The flow rate of the hydraulic fluid to be supplied to the first actuator 8 is increased by the amount corresponding to the decreased flow rate, and the driving speed of the first actuator 8 is increased.

Figure 7:
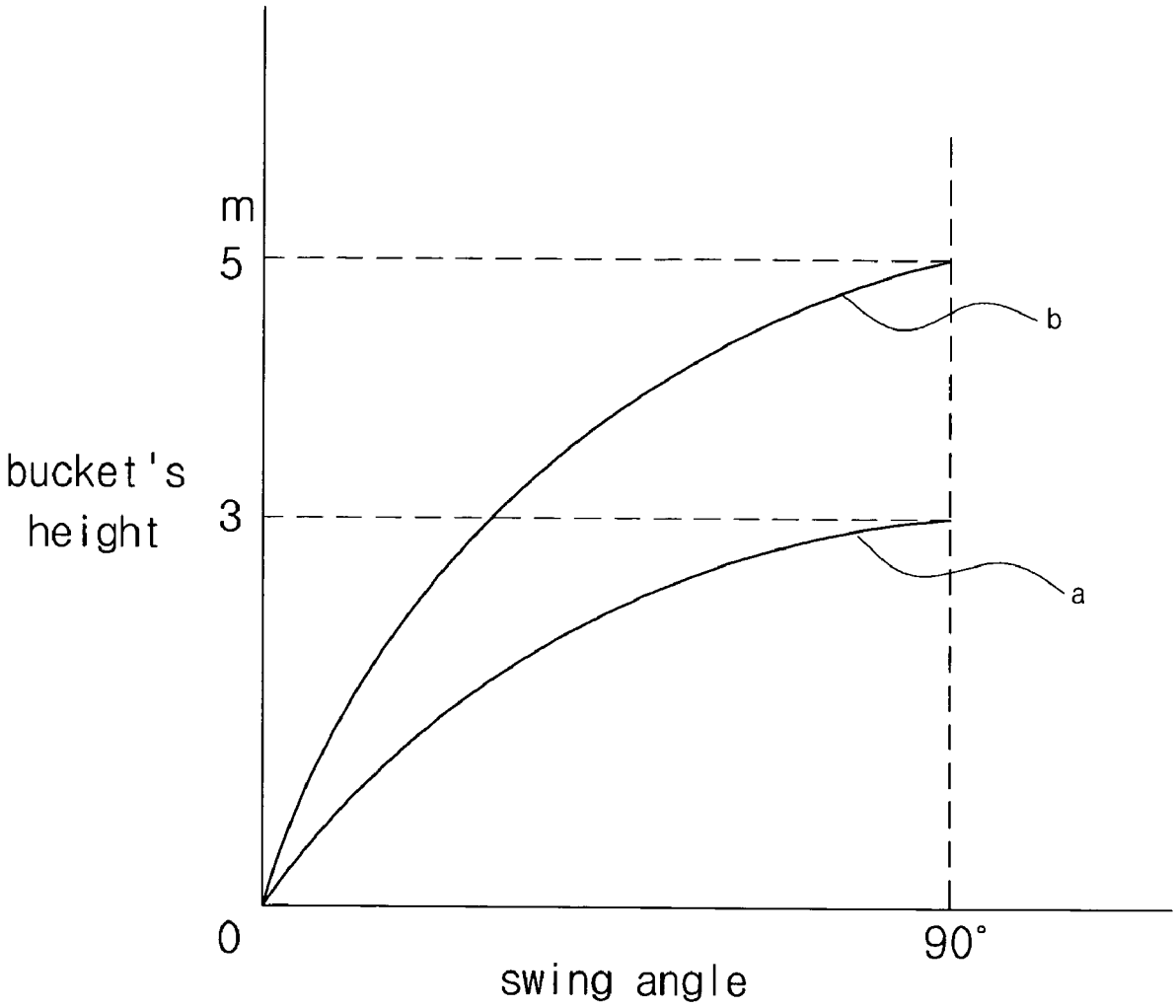
FIG. 7 is a graph depicting the relation between a swing angle and a bucket's height when a boom is lifted simultaneously with the rotation of an upper swing structure.

As shown in FIG. 7, when the excavator loads soil into a dump truck, the upper swing structure 5 is generally rotated in a horizontal plane at an angle of 90 degrees. As a result of a road test, when the conventional upper swing structure 5 was rotated in a horizontal plane at an angle of 90 degrees after excavation, the height of the bucket 13 lifted from a frame of the dump truck was 3 meters (indicated as curve a).

When the upper swing structure 5 was rotated in a horizontal plane at an angle of 90 degrees after excavation, the height of the bucket 13 lifted from a frame of the dump truck was 5 meters (indicated as curve b). Therefore, in the case of manipulating the boom lift simultaneously with the swing drive of the upper swing structure, the lifting speed of the boom 9 becomes faster, and the rotation speed of the upper swing structure 5 becomes relatively slower, so that it is not necessary for the operator to artificially decrease the rotation speed of the upper swing structure 5 during working.

Figure 8:
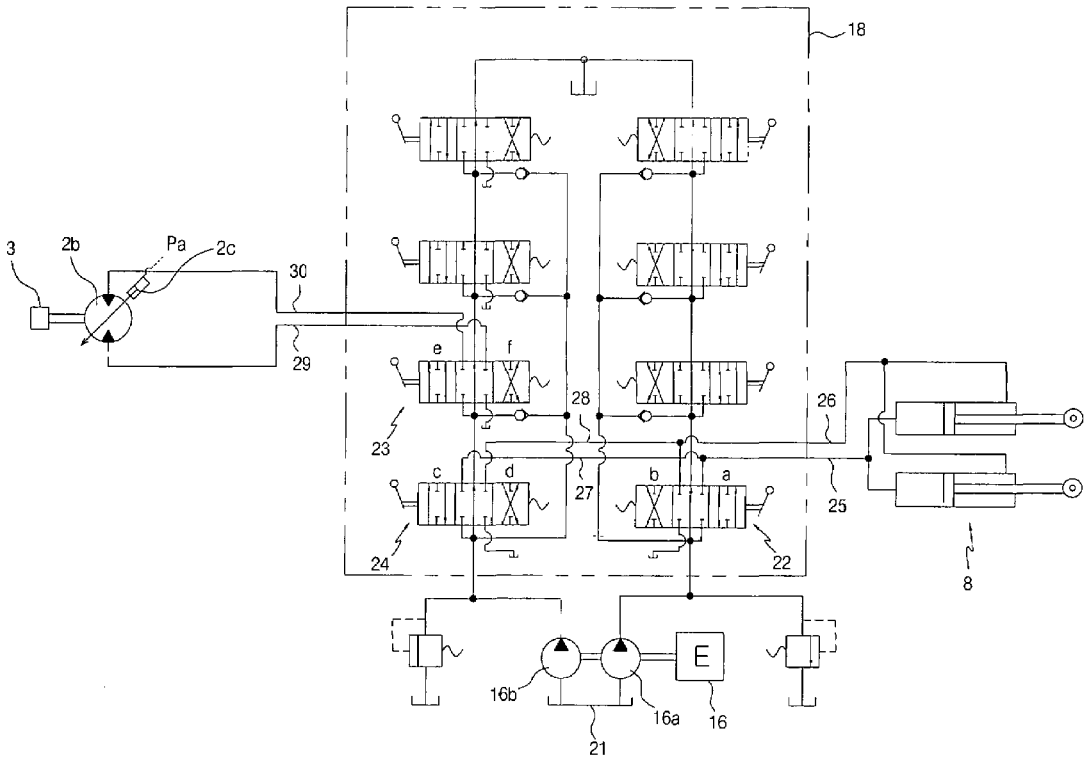
FIG. 8 is a hydraulic circuit diagram of an apparatus for increasing an operation speed of a boom on excavators according to another embodiment of the present invention.
Figure 9:
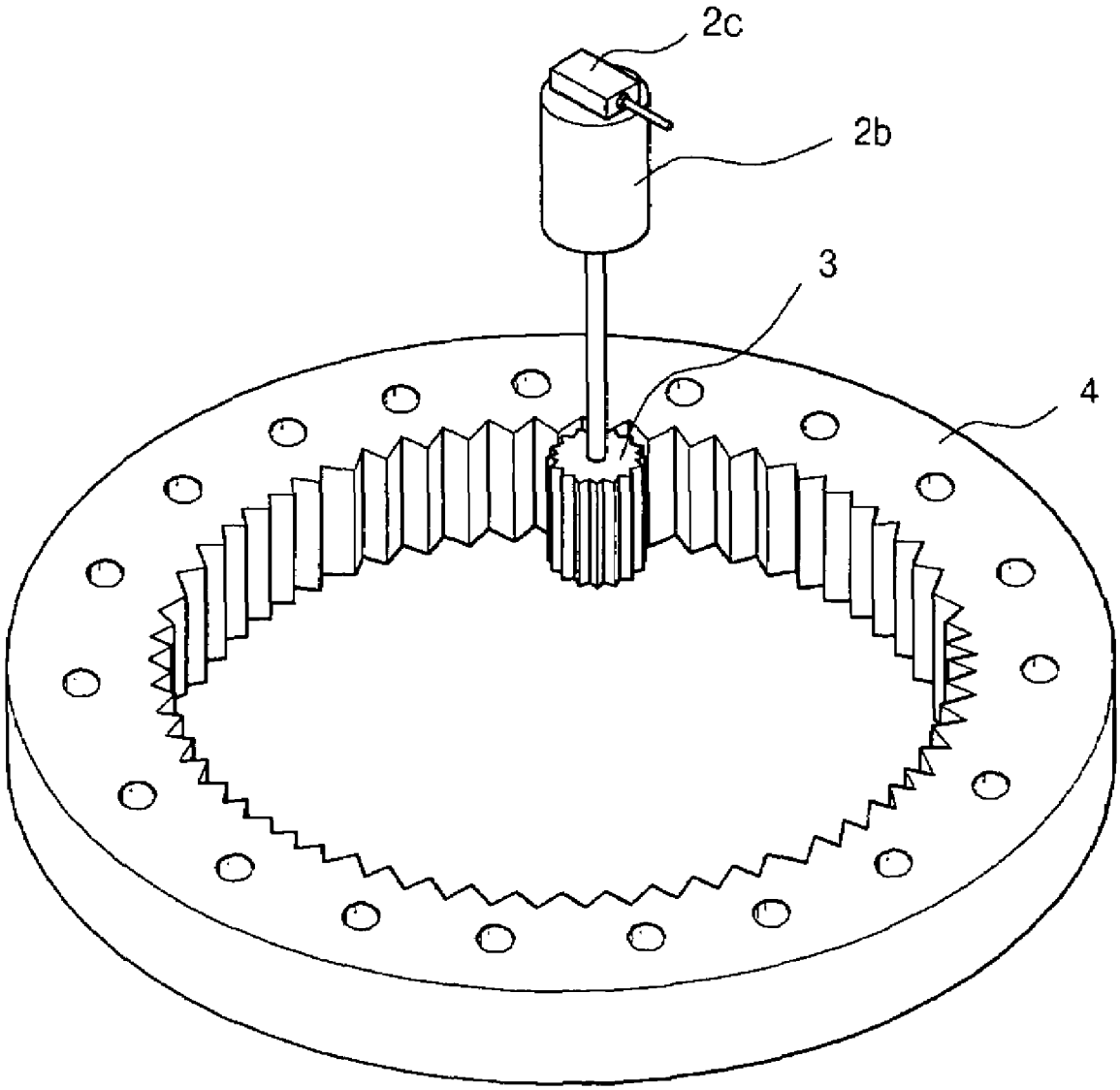
FIG. 9 is a perspective view explaining the mechanism connecting an upper swing structure and a swing motor according to another embodiment of the present invention.

On the other hand, an apparatus for increasing an operation speed of a boom on excavators according to another embodiment of the present invention includes, as shown in FIGS. 8 and 9, first and second hydraulic pumps 16*a* and 16*b* connected to an engine 16; a first actuator 8 (i.e., a boom cylinder) connected to the first hydraulic pump 16*a*; a second variable displacement actuator 2*b* (i.e., a swing motor) connected to the second hydraulic pump 16*b*; a first control valve 22 installed in flow paths 25 and 26 between the first hydraulic pump 16*a* and the first actuator 8 and switched to control startup, stop, and turnabout of the first actuator 8 when a control signal is input from an exterior; a second control valve 23 installed in flow paths 29 and 30 between the second hydraulic pump 16*b* and the second actuators 2 and 2*a* and switched to control startup, stop, and turnabout of the second actuator 2 when a control signal is input from an exterior; a third control valve 24 installed in flow paths 27 and 28 between the second hydraulic pump 16*b* and the first actuator 8 (in this case, the flow paths 27 and 28 are communicated with the flow paths 25 and 26 connected to the first control valve 22) and switched to join a part of the hydraulic fluid of the second hydraulic pump 16*b* into the first actuator 8 when a control signal is input from an exterior; and a variable displacement device 2*c* (e.g., a piston) installed in the second actuator 2*b*, which is driven according to a control signal Pa of boom lift at combined operation in which the first and second actuators 8 and 2*b* are simultaneously driven (to adjust the discharge flow rate by controlling the inclination angle of a swash plate of the second actuator 2*b*), to replenish the first actuator 8 with the part of the hydraulic fluid from the second hydraulic pump 16*b* to the second actuator 8.

The second variable displacement actuator 2*b* may operate in a maximum displacement discharge mode in which the maximum torque is outputted or in a minimum displacement discharge mode in which torque of about 50% is outputted through the driving of the variable displacement device 2*c*.

In this case, a pilot signal pressure or an electric signal switching the third control valve 24 to drive the first actuator 8 may be used as the control signal Pa driving the variable displacement device 2*c*.

Also, a pilot signal pressure or an electric signal switching the first control valve 22 to drive the first actuator 8 may be used as the control signal Pa driving the variable displacement device 2*c*.

Since the construction of the apparatus according to another embodiment of the present invention is substantially equal to that of the apparatus illustrated in FIG. 3, except for the second variable displacement actuator 2*b* and the variable displacement device 2*c*, the same constituent elements are denoted by the same reference numerals, and the detailed description of their structure and operation will be omitted.

The apparatus for increasing the operation speed of a boom on excavators according to another embodiment of the present invention will now be described with reference to the accompanying drawings.

As shown in FIGS. 8 and 9, the first actuator 8 is driven by the hydraulic fluid that is discharged from the first hydraulic pump 16*a* through the switching of the first control valve 22, and thus the boom is moved up and down by the first actuator 8 being driven. The second variable displacement actuator 2*b* is driven by the hydraulic fluid that is supplied from the second hydraulic pump 16*b* through the switching operation of the second control valve 23, and thus the upper swing structure 5 is rotated. At this time, by replenishing the first actuator 8 with a part of the hydraulic fluid supplied from the second hydraulic pump 16*b* through the switching of the third control valve 24, the lifting speed of the boom can be heightened.

On the other hand, at the excavation and loading work on to a dump truck, the upper swing structure is rotated simultaneously with the boom lifting in order to cut down the cycle time. In this case, due to the load carried on the bucket, the boom lifting speed becomes lower, and the rotation speed of the upper swing structure relatively becomes higher. Accordingly, it is required for the operator to artificially decrease the rotation speed of the upper swing structure.

That is, the boom is lifted by supplying the hydraulic fluid from the first hydraulic fluid to the first actuator 8 through the manipulation of the first control valve 22. Simultaneously, the hydraulic fluid from the second hydraulic pump 16*b* is supplied to the second actuator 2*b* through the manipulation of the second control valve 23.

Accordingly, a pinion gear 3 and an internal gear 4, which are meshed with each other, are rotated by the driving force that is outputted from the second actuator 2*b*, to rotate the upper swing structure 5.

In this case, if the control signal Pa (e.g., the pilot signal pressure or the electric signal switching the first control valve 22 or the third control valve 24) is inputted to the variable displacement device 2*c* installed in the second actuator 2*b* in order to heighten the boom lifting speed, the second actuator 2*b* is switched over to the minimum displacement discharge mode.

Accordingly, the torque of the second actuator 2*b* becomes smaller to reduce the rotation speed of the upper swing structure, and this causes the flow rate of the hydraulic fluid from the second hydraulic pump 16*b*, which is required for the rotation of the upper swing structure, to be reduced. The flow rate of the hydraulic fluid to be supplied to the first actuator 8 is increased by the amount corresponding to the decreased flow rate, and thus the boom lifting speed becomes higher.

That is, at the excavation and loading work on to a dump truck, the boom lifting speed is increased as the rotation speed of the upper swing structure is relatively reduced. As a result of a road test, it has been confirmed that when the upper swing structure is rotated at an angle of 90 degrees for the excavation and loading work on to a dump truck, the height of the bucket is increased from 3 meters (indicated as curve "a" in FIG. 7) to 5 meters (indicated as curve "b" in FIG. 7).

Accordingly, it is not necessary for the operator to artificially decrease the rotation speed of the upper swing structure 5 during the excavation and loading working.

As described above, the apparatus for increasing the operation speed of a boom on excavators according to the embodiments of the present invention has the following advantages.

When the operator conducts the combined operation containing the boom lift and the swing drive of the upper swing structure, a cycle time can be shortened by reducing the rotation speed of the upper swing structure and relatively increasing the lifting speed of the boom, thereby improving the working efficiency.

Also, in the case of lifting the boom simultaneously with the rotation of the upper swing structure, even unskilled operator can easily perform the operation.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An apparatus for increasing an operation speed of a boom on excavators, comprising:

first and second hydraulic pumps;

a first actuator connected to the first hydraulic pump;

a pair of second actuators connected to the second hydraulic pump and connected in series to each other;

a first control valve installed in a flow path between the first hydraulic pump and the first actuator, which functions to control startup, stop, and turnabout of the first actuator;

a second control valve installed in a flow path between the second hydraulic pump and the second actuators, which functions to control startup, stop, and turnabout of the second actuators;

a third control valve installed in a flow path between the second hydraulic pump and the first actuator, which functions to join a part of a hydraulic fluid of the second hydraulic pump into the first actuator; and a block valve installed in the flow path between the second actuators and the second control valve, supplying the hydraulic fluid from the second hydraulic pump to one of the second actuators to be selected only when the second actuators are driven to be switched according to a control signal of boom lift at combined operation in which the first and second actuators are simultaneously driven, to replenish the first actuator with the hydraulic fluid to be supplied to the second actuator.

2. The apparatus as claimed in claim 1, wherein a pilot signal pressure switching the third control valve to drive the first actuator is used as the control signal switching the block valve.

3. The apparatus as claimed in claim 1, wherein an electric signal switching the third control valve to drive the first actuator is used as the control signal switching the block valve.

4. The apparatus as claimed in claim 1, wherein the block valve is switched by physical manipulation of an operator.

5. The apparatus as claimed in claim 1, wherein a pilot signal pressure switching the first control valve to drive the first actuator is used as the control signal switching the block valve.

6. The apparatus as claimed in claim 1, wherein an electric signal switching the first control valve to drive the first actuator is used as the control signal switching the block valve.

7. The apparatus as claimed in claim 1, wherein the first actuator is a boom cylinder, and the second actuator is a swing motor.

* * * * *